United States Patent [19]

Yeu

[11] Patent Number: 4,801,285

[45] Date of Patent: Jan. 31, 1989

[54] FIGURE TOY HAVING A THREE-POSITION SWITCH AND TWO MODES OF OPERATION

[75] Inventor: Nam J. Yeu, Seoul, Rep. of Korea

[73] Assignee: Michael & Park's Trading And Sales, Inc., Honolulu, Hi.

[21] Appl. No.: 18,913

[22] Filed: Feb. 25, 1987

[51] Int. Cl.[4] ..... A63H 3/28; A63H 11/00

[52] U.S. Cl. ..... 446/298; 446/303; 446/353

[58] Field of Search ..... 446/297, 298, 353, 354, 446/463, 484, 303; 200/16 D, 60

[56] References Cited

U.S. PATENT DOCUMENTS

| | | | |
|---|---|---|---|
| 2,491,914 | 12/1949 | Anderson | 200/60 |
| 2,566,280 | 8/1951 | Yandt | 200/60 |
| 4,025,743 | 5/1977 | Oswald | 200/60 |
| 4,188,750 | 2/1980 | Lohr | 446/460 |
| 4,271,378 | 6/1981 | Knauff | 446/427 |
| 4,535,392 | 8/1985 | Montgomery | 200/60 |
| 4,545,775 | 10/1985 | Kim | 446/299 |
| 4,562,893 | 1/1986 | Cunard | 446/460 |
| 4,573,939 | 3/1986 | Hoshino | 446/298 |
| 4,573,943 | 3/1986 | Kennedy et al. | 446/463 |
| 4,676,764 | 6/1987 | Yeu | 446/298 |

FOREIGN PATENT DOCUMENTS

| | | | |
|---|---|---|---|
| 489444 | 11/1974 | Austria | 200/16 D |
| 473860 | 3/1929 | Fed. Rep. of Germany | 446/354 |
| 1299659 | 6/1962 | France | 446/354 |
| 2259633 | 8/1975 | France | 446/354 |
| 334779 | 9/1930 | United Kingdom | 446/353 |
| 1269708 | 4/1972 | United Kingdom | 446/298 |

OTHER PUBLICATIONS

Product Engineering, "This Locomotive Shifts Gears", Jan. 5, 1959, p. 53.

*Primary Examiner*—Robert A. Hafer
*Assistant Examiner*—Charles H. Harris
*Attorney, Agent, or Firm*—George W. T. Loo

[57] ABSTRACT

A working toy which alternately moves its hips left and right while slowly turning counterclockwise and a Hawaiian melody is heard to give a lifelikeness that compares with a real hula dancer. The toy includes an upper portion, a lower portion, and a base portion. The upper portion resembles the head through waist of a human; the lower portion resembles the waist through hip portion of a human. The upper portion is pivotally connected to the lower portion by a hinge pin. The base portion supports the upper portion and the lower portion by a support bar, one end of which is secured to the base portion and the other end of which is placed in a cavity within the body of the upper portion. The base portion includes a housing with a rotating base secured to its bottom portion, a stationary base with feet spaced below the rotating base, a three-way switch, a battery, a motor, a melody I.C., a speaker, a drive gear, a cam, an actuator arm, gearing which will transmit the motion of the motor to the cam and will cause the rotating base to rotate slowly. When the switch is turned on to the first position, a Hawaiian melody is heard; when the switch is turned on to the second position, the motor turns the cam that in turn moves the actuator arm alternately up and down that in turn moves the hips of the toy left and right, while the toy slowly turns counterclockwise and a Hawaiian melody is heard.

2 Claims, 2 Drawing Sheets

FIGURE TOY HAVING A THREE-POSITION SWITCH AND TWO MODES OF OPERATION

BACKGROUND OF THE INVENTION

1. Field of Invention.

This invention relates to dancing hula dolls.

2. Description of the Prior Art.

Most hula dolls are not lifelike as they do not move their hips. My invention provides a dancing hula doll that shakes her hips in such a manner that she appears to be lifelike.

3. Disclosure Statement.

Kim, U.S. Pat. No. 4,545,775, issued Oct. 8, 1985, discloses a dancing hula doll which alternatively moves its hips left and right while slowly turning counterclockwise and a Hawaiian melody is heard.

My invention is a dancing hula doll which alternatively moves its hips left and right while slowly turning counterclockwise and a Hawaiian melody is heard, but is an improvement in apparatus from the doll of Kim. This improvement in apparatus results in a lower manufacturing cost of approximately 25%.

SUMMARY OF THE INVENTION

This invention relates to a hula doll which alternately moves its hips left and right to give a lifelikeness that compares with a real hula dancer. A battery operated motor turns a cam that in turn reciprocally moves an actuator arm up and down in order to move the hips of a hula doll left and right alternatively while it slowly rotates in a counterclockwise direction and a Hawaiian melody is heard.

An object of this invention is to provide a hula doll which alternatively moves its hips left and right while slowly rotating and a melody is heard.

Another object of this invention is to provide a dancing hula doll which cost less to manufacture than presently made dancing hula dolls.

A further object of this invention is to provide a hula doll which becomes a hula dancer when battery power is turned on.

Still another object of this invention is to provide a working toy that will enable children to feel a rhythmical sense and a lively motion while playing with the toy.

A still further object of this invention is to provide a working toy that concurrently gives a shake and a turn to its lower part from side to side and makes children feel unwearying of playing with it by means of a melody which provides a rhythmical sense and a lively motion.

Other objects, features and advantages of the present invention will be readily apparent from the following detailed description taken in connection with the accompanying drawings.

DESCRIPTION OF THE PREFERRED EMBODIMENT

Before explaining the present invention in detail it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not limitation.

Figure 1:
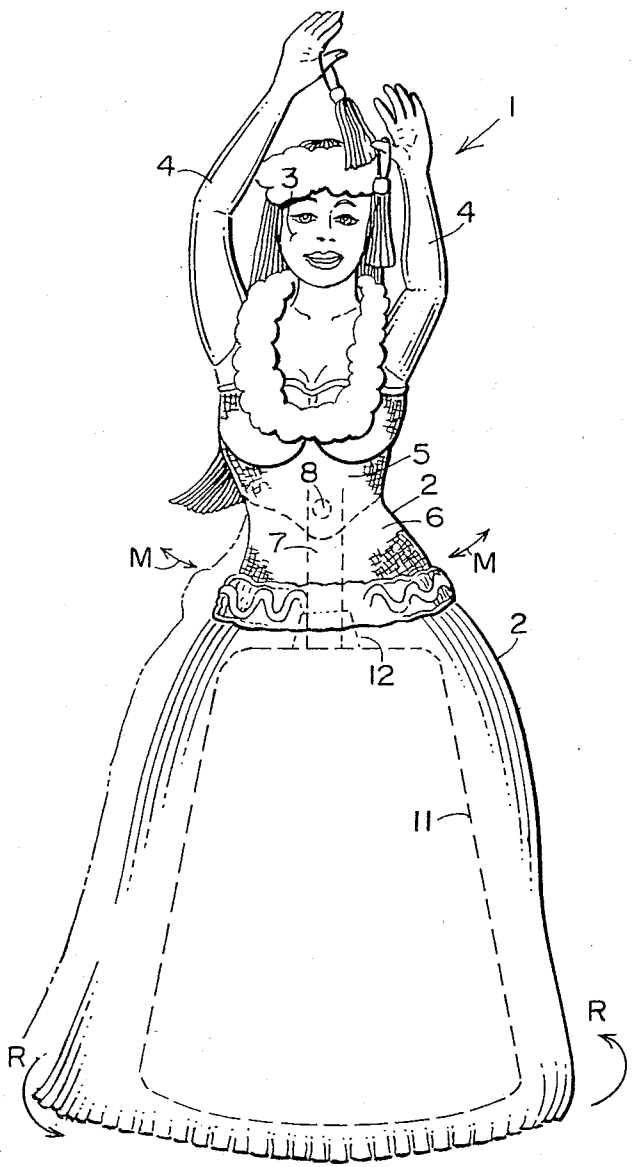
FIG. 1 is a front elevational view of the working toy.
Figure 7:
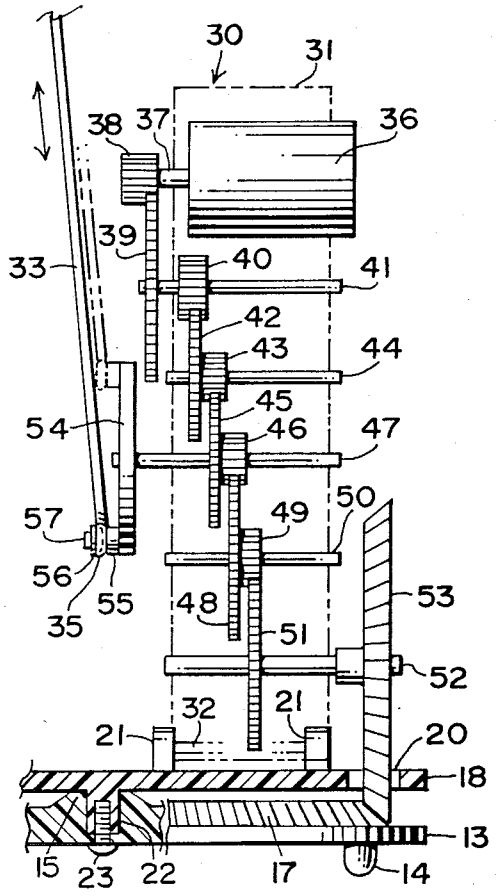
FIG. 7 is a schematic view of motor/gear drive assembly of the working toy laid out flat for clarity.
Figure 6:
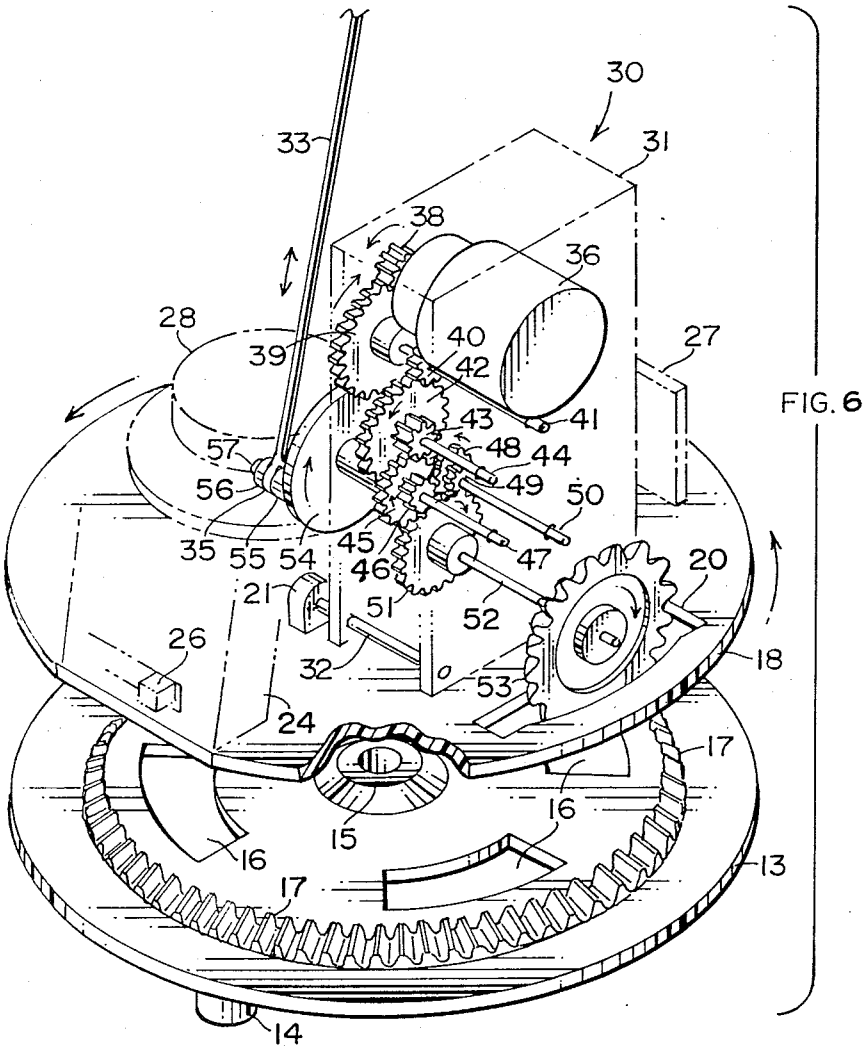
FIG. 6 is an enlarged exploded view of main propulsion of the working toy.

Referring now to the drawings wherein like reference numerals and letters refer to like and corresponding parts throughout the several views, the preferred embodiment of the invention disclosed in FIGS. 1–7 inclusive is a working toy 1. Working toy 1 includes an upper portion U, a lower portion L, and a base portion B. Costume 2 covers working toy 1 as shown in FIG. 1.

Upper portion U resembles the head through waist of a human. Lower portion L resembles the waist through hip portion of a human. The upper portion U and the lower portion B overlap at the waist area and are pivotally connected to each other by a hinge pin 8. Base portion B supports the upper portion U and the lower portion L by a u-shaped support bar 7, one end of which is secured to a bar support 12 by a screw 10 and the other end is placed in cavity 5a within a body 5 of upper portion U. Lower portion L is spaced from the top of base portion B a predetermined distance to allow the alternate movements of hips 6 to the left and to the right. See FIGS. 1–3.

Upper portion U includes a head 3, arms 4, a body 5 with cavity 5*a*, and a hinge pin 8. Hinge pin 8 pass through support bar 7 in order to stabilize it. Head 3 and arms 4 may be turned in the direction of arrows designated by reference letter S.

Lower portion B includes hips 6 and hip connector 9 with opening 9*a*.

Base portion B includes a housing 11 with an opening 11a, support bar 7, screw 10, bar support 12, stationary base 13 with feet 14, bearing support 15, sound openings 16, and bevel gear 17, rotating base 18 with speaking opening 19, gear opening 20, motor drive and gear box supports 21, and axle 22, screws 23, battery compartment 24 with batteries 25 and three way switch 26, I.C. Electronic Melody Circuit 27, speaker 28, wiring 29, motor drive and gear box assembly 30, attaching pins 32, and actuator arm 33.

Motor drive and gear assembly 30 includes motor drive and gear box 31, motor 36, drive shaft 37, drive gear 38, gears 39, 40, 42, 43, 45, 46, 48, 49, and 51, shafts 41, 44, 47, 50, and 52, bevel gear 53, cam 54 with projection 55, washer 56, and screw 57.

Actuator arm 33 includes a hook 34 at one end and a loop 35 at the other end. Hook 34 is connected to hip connector 9 by means of opening 9*a* within hip connector 9. See FIG. 5. Loop 35 is connected to projection 55 by means of washer 56 and screw 57. Actuator arm 33 passes through opening 11a in housing 11.

Screws 23 secure the rotating base 18 to the bottom of the housing 11. Motor drive and gear box 31 is secured to rotating base 18 by means of motor drive and gear supports 21 and attaching pins 32. Battery compartment 24 fits within the side of housing 11.

Projection 55 includes two-sized cylinders with the smaller sized cylinder located on the outside. Loop 35 loosely fits around the smaller sized cylinder and is kept in position by washer 56 and screw 57 on one side and the larger sized cylinder on the other side. Screw 57 is screwed into the smaller sized cylinder. Projection 55 is located off center of cam 54 so that the circular motion of cam 54 will be converted into up-and-down motion of actuator arm 33. The up-and-down motion of actuator arm 33 results in left-and-right motion of hips 6. Reference letter M denotes the left-and right motion of hips 6 and the nearby arrows show the direction of motion. See FIG. 1.

The gears are arranged so that motion of motor 36 is transmitted to cam 54 and to bevel gear 53 for the purpose of causing actuator arm 33 to move alternately up and down and causing rotating base 18 to rotate. Reference letter R denotes rotation and the curved arrows nearby show the direction of rotation. See FIG. 1.

Figure 4:
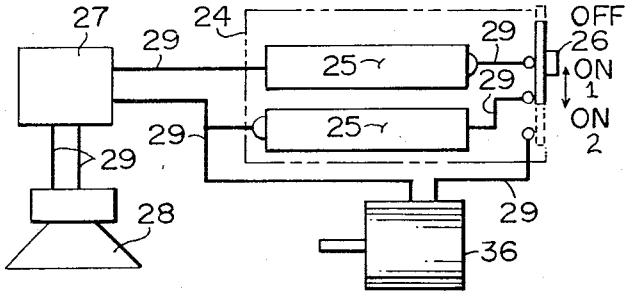
FIG. 4 is an electrical schematic view of the working toy.
Figure 3:
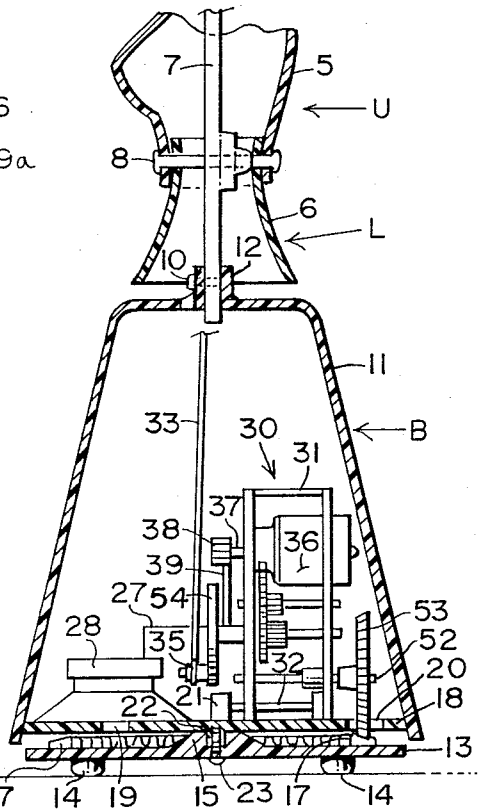
FIG. 3 is a right elevational cutaway view of the working toy with lower portion, base portion, and part of upper portion cutaway and the actuator arm in the lower position.
Figure 5:
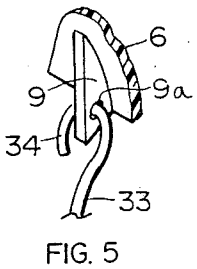
FIG. 5 is a perspective detail view looking in direction of the arrows of line 5—5 of FIG. 2 to illustrate the connection of hip connector to the hips and the connection of the actuator arm hook with the hip connector.
Figure 2:
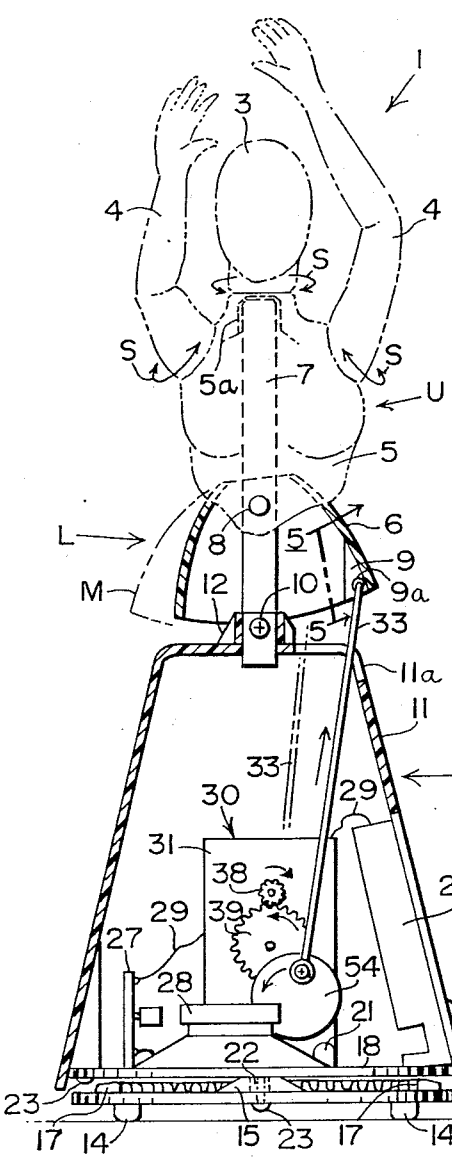
FIG. 2 is a front elevational schematic view of the working toy with lower portion and the base portion cutaway and the actuator arm in the upper position.

The operation of my invention is as follows: When power is turned on by switch 26 to position on 1, a melody is heard. When switch 26 is moved to position on 2, working toy 1 becomes a hula dancer. Motor 36 turns cam 54 that in turn activates actuator arm 33 by means of projection 55. Actuator arm 33 moves up and down that in turn causes hips 6 to alternately move left and right as shown in FIGS. 1 and 2. While hips 6 of working toy 1 is alternately moving left and right, working toy 1 is slowing moving in a counterclockwise direction and a Hawaiian melody is heard. Upper portion U remains stationary while lower portion L alternately moves left an right to give working toy 1 a lifelikeness that compares with a real hula dancer.

Although but a single embodiment of the invention has been disclosed and described herein, it is obvious that many changes may be made in the size, shape, arrangements, color and detail of the various elements of the invention without departing from the scope of the novel concepts of the present invention.

I claim as my invention:

1. A figure toy comprising: an upper portion, a lower portion, and a base portion; the upper portion resembling the head through waist of a human; the lower portion resembling the waist through hip portion of a human; a pin pivotably connecting the upper portion to the lower portion; a support bar supporting the upper portion and the lower portion above the base portion, one end of said support bar secured to the base portion and the other end said support bar located in a cavity in the body of the upper portion; means to alternately move the lower portion in a left and right direction including a motor, a drive gear, a cam, and an actuator arm, said drive gear being connected to a shaft of the motor, said cam being operatively connected to the drive gear, one end portion of the actuator arm being operatively connected to the cam and the other end portion of the actuator arm being connected to a hip connector located within the lower portion and at its side; said base portion including a housing, a rotating base, a stationary base with feet, bevel gears for turning the rotating base, a three-position switch, a speaker, a melody I.C., and a battery; the rotating base has an axle at its center portion which rotates within a bearing support located at the center portion of the stationary base; said bevel gears being operatively connected to the drive gear; said battery is connected to the side of the housing; and wiring that connect the switch, the speaker, the melody I.C., and the motor to the battery, said actuator arm is a bar with a hook at one end and a loop at the other end, the hook is connected to the hip connector and the loop is connected to a projection on the cam; said three-position switch has a first position which is the off position, a second position which actuates the melody I.C. causing music to be heard, and a third position which both actuates the melody I.C. causing music to be heard and actuates the motor causing said lower portion to move;

the housing of the base portion is a truncated cone with an opening at its top near its side and the rotating base is secured within the housing adjacent its bottom portion; the speaker is secured to the rotating base and a speaker hole is located in the rotating base near the speaker.

2. The figure toy of claim 1, wherein the lower portion is spaced a predetermined distance from the top of the base portion.

* * * * *